US005606785A

United States Patent [19]

Shelberg et al.

[11] Patent Number: 5,606,785

[45] Date of Patent: Mar. 4, 1997

[54] AIR BLADDER POSITIONER FOR CADAVERS

[75] Inventors: Robert A. Shelberg, Haledon; Joseph Petrone, Ringwood, both of N.J.

[73] Assignee: Position-Aire, Inc., Bergenfield, N.J.

[21] Appl. No.: 246,321

[22] Filed: May 19, 1994

[51] Int. Cl.[6] ..... A61G 17/00

[52] U.S. Cl. ..... 27/19; 5/715

[58] Field of Search ..... 5/449, 450, 481; 27/12, 19

[56] References Cited

U.S. PATENT DOCUMENTS

| | | | |
|---|---|---|---|
| 587,224 | 7/1897 | McKelvey . | |
| 795,108 | 7/1905 | Doellinger . | |
| 1,068,355 | 7/1913 | McComb | 5/640 |
| 1,491,146 | 4/1924 | Larson . | |
| 1,510,187 | 9/1924 | Martin . | |
| 2,618,041 | 11/1952 | Nelson | 27/13 |
| 3,308,491 | 3/1967 | Spence | 5/348 |
| 3,604,026 | 9/1971 | Schelps | 5/640 X |
| 3,689,949 | 9/1972 | Weinstein | 5/449 X |
| 3,955,252 | 5/1976 | Reda | 27/12 |
| 3,968,530 | 7/1976 | Dyson | 5/449 X |
| 4,042,988 | 8/1977 | Holliday | 5/450 |
| 4,339,151 | 7/1982 | Riggs | 297/464 |
| 4,631,765 | 12/1986 | Casey | 5/420 X |
| 4,901,386 | 2/1990 | Lane | 5/450 |
| 4,995,124 | 2/1991 | Wridge | 5/450 |
| 4,998,301 | 3/1991 | Markus | 4/457 |
| 4,999,068 | 3/1991 | Chiarella | 5/449 X |
| 5,005,236 | 4/1991 | Hutchinson | 5/450 X |
| 5,020,168 | 6/1991 | Wood | 4/573 |
| 5,027,455 | 7/1991 | Commisso | 5/420 X |
| 5,033,133 | 7/1991 | Nissen | 5/450 |
| 5,049,102 | 9/1991 | Hull | 5/449 X |
| 5,142,717 | 9/1992 | Everard et al. | 5/450 |
| 5,201,102 | 4/1993 | McClure | 27/12 |
| 5,231,718 | 8/1993 | Blaha | 5/450 X |
| 5,329,656 | 7/1994 | Leggett | 5/420 X |
| 5,452,487 | 9/1995 | Leggett | 5/481 X |

*Primary Examiner*—Carl D. Friedman
*Assistant Examiner*—Beth Aubrey
*Attorney, Agent, or Firm*—Friscia & Nussbaum

[57] ABSTRACT

An inflatable air mattress positioner is provided for use with a casket, coffin or alternative container. The assembly includes a partially pneumatic pillow with a chamber in which is disposed a plurality of air chambers, each one of which has a corresponding air tube and valve assembly in communication therewith. A cushion material is also included in the pillow. The cushion material coacts with the air bladders to position the head, upper arm, chest and shoulder region of a cadaver so that the cadaver chin is disposed in an acceptable proper height in relation with the chest according to that which is acceptable to the mortician and mourners. In addition, the assembly includes an inflatable air mattress having a plurality of air chambers which are independently inflatable to position a cadaver at an appropriate height and angle in the casket for mourner viewing. Additional separate independent air bladders are also provided to be disposed under the cadaver to aid in positioning the cadaver and tilt the cadaver along its longitudinal axis for mourner viewing as well as positioning the back, arms, head, neck or any other part of the cadaver that requires adjustment.

12 Claims, 3 Drawing Sheets

AIR BLADDER POSITIONER FOR CADAVERS

BACKGROUND OF THE INVENTION

1. FIELD OF THE INVENTION

This invention relates to an inflatable air mattress positioner system adapted to be removably installed in a casket to support a cadaver in a desired position for viewing.

2. BACKGROUND OF THE INVENTION

Support systems for human beings are common and employed for a variety of physiological, protective and relaxation applications, as shown in U.S. Pat. Nos. 587,224, 795,108, 1,491,146, 1,510,187, 3,308,491, 4,339,151, 4,424, 599, 4,694,520, 4,949,412, 4,986,738, 4,998,301, 5,020,168 and 5,103,519. Support devices are also used to support cadavers as disclosed in, for example, U.S. Pat. Nos. 2,099, 977, 2,618,041, 2,859,505, 3,955,252, and 5,201,102.

Conventional support systems used in caskets, coffins and alternative containers consist of an adjustable spring-mattress system that can be raised or lowered and tilted to some extent from side to side and from head to foot, in a plane, by a crank-screw system to position the cadaver for viewing. It has been found, however, that the crank-screw system cannot in all circumstances completely position the cadaver so as to be aesthetically pleasing for mourners. Consequently, it is often necessary to support various portions of the body with objects such as conventional pillows, empty formalin bottles, tissue paper or other objects. Such objects selected are positioned beneath the body to affect the body so that the position of the cadaver is favorable for the mourners' viewing.

The conventional spring-mattress system is costly, both for its moving parts and labor intense manufacturing, and for mounting in an existing casket. This system is not easily reusable and is ultimately disposed of with the casket regardless of the final method of disposition (cremation, burial or entombment).

Alternatively, it has been found in the art to omit use of the spring-mattress system and to line the bottom of the casket, coffin or alternative container with wood shavings and/or excelsior or other types of filler material to form a "mattress" for the remains. Again, the mortician must mold the bed of shavings or excelsior to the body so that the body is in an acceptable viewing position. This entails extracting the filling from beneath the cadaver or inserting additional filling or readjusting the existing filling at a particular point beneath the body. This method can be time consuming and can result in the need for further adjustment or support of the cadaver with conventional pillows, empty formalin bottles, tissue paper or other objects so that the position of the cadaver is once again favorable for the mourners' viewing. This system however, almost always requires the mortician to remove the material from under the cadaver to close the casket lid. The remaining filling is lost to the burial, cremation or entombment.

It is also known to insert or remove filling in a pillow for use to support the head of the cadaver in an acceptable position for mourner viewing. However, the same disadvantages of lack of adjustment which are common to the mattress leads to the need of additional positioning materials such as additional pillows, bottles, tissue paper or other objects to achieve the desired position of the cadavers head.

Additionally, a problem with the cadaver positioning systems of the prior art is that the head and back of the cadaver that is being prepared for viewing is not always acceptable when it is initially placed in the casket, coffin or alternative container. The chin may be positioned too close or too far from the chest so that the chin exceeds that which would be acceptable to mourners or look natural with respect to the chest on a vertical plane. In order to correctly position the head, any number of different materials such as empty formalin bottles, conventional pillows, tissue paper and other objects must be placed under the middle of the cadaver's back to raise the back and position the head to an acceptable standard of height for mourner viewing. This current technique is often time consuming, requires many adjustments and could be perceived as less than professional if the additional positioning materials were seen by the mourners and the general public.

Some attempts have been implemented to correct the disadvantages of the support devices and methods currently employed in the funeral industry as follows:

McKelvey, U.S. Pat. No. 587,224, discloses an inflatable headrest used with dental, surgical or other chairs. The pad is made of a molded rubber having an oblong or oval shape. The upper side is depressed to adapt to the shape of the head of the patient and the underside is attachable to a support.

Doellinger, U.S. Pat. No. 795,108, discloses a pneumatic pillow comprising an inflatable rubber bag covered by a pillow case. An air pump is contained within the pillow for inflating the pillow.

Larson, U.S. Pat. No. 1,491,146, discloses a head cushion comprising a plurality of substantially elliptical pieces of pliable material secured together around the edges to provide a closed chamber therewithin. This chamber may be inflated with air to provide padding. Bands are provided to the cushion to surround the person's head to attach the cushion thereto.

Martin, U.S. Pat. No. 1,510,187, discloses an inflatable head rest comprising a pillow adapted to rest in the hollow of a person's neck. The pillow projects forward over the shoulder of the person in a U-shape extending close to the neck and sides of the head. Straps are attached to the pillow to attach it to the person's body to hold it in place. The tube may be inflated to a desired inflation during use and deflated for packing and storage.

Nelson, U.S. Pat. No. 2,618,041, discloses an embalmer's headrest comprising a base and a head support. The headrest may be vertically adjusted with respect to the base.

Spence, U.S. Pat. No. 3,308,491, discloses a cushion containing a hydrostatic gel covered with a highly elastic material. This cushion readily adapts itself to the contour of the surface of the supported body.

Reda, U.S. Pat. No. 3,955,252, discloses a corpse positioner and restrainer with a rigid support member and a cradling portion disposed thereon. The device is sold in a collapsed form and may be assembled by moving the transverse portions toward each other. The device may be formed from corrugated pasteboard.

Riggs, U.S. Pat. No. 4,339,151, discloses a head restraint for supporting a head while a person is seated in a chair. The device includes a strap that can be wrapped around the back of the chair and an adjustable headband secured to the strap of the head band which includes a head strap to encircle the user's head. Adhesive patches are provided on the head strap to secure the head strap about the user's head.

Markus, U.S. Pat. No. 4,998,301, discloses a collapsible bed pan support made of a thin flexible material which may be inflated to support the body to cause the upward sloping of the body from the back towards the buttox and thigh areas of the patient. The support is relatively thin and can remain under the patient. The support allows the patient to use a normal bedpan.

Wood, U.S. Pat. No. 5,020,168, discloses an inflatable handicapped chair for use by a handicapped person in bathing. The chair has a base, a back, and a plurality of individually inflatable portions to fit the handicapped person.

McClure, U.S. Pat. No. 5,201,102, discloses a casket bed system that comprises a mattress with a plurality of independently inflatable sections to position a cadaver in the casket. Means are provided to position the head vertically with respect to the feet, to angle the upper torso, and to adjust the head relative to the chest to properly space the chin from the chest.

However, among these references, there is lacking a partially pneumatic pillow which is structured of an inflatable bladder with one or more chambers independently adjustable of one another and padding to adjustably position the head of the cadaver, particularly the chin with respect to the chest and the remaining part of the body, and a system of independent air bladders which can be used with this or any other support system to assist in positioning the back, arms or any other part of the cadaver that requires adjustment, as well as an inflatable air mattress support system with the structure and benefits of the present invention, which is inexpensive to manufacture, completely reusable, retrofittable to existing caskets, coffins or alternative containers and adapted for being removably installed within a casket, coffin or alternative container without altering the structure of the casket or any other positioning system already installed in the casket or having the capability of completely replacing any existing positioning system currently in use in caskets, coffins or alternative containers.

OBJECTS AND SUMMARY OF THE INVENTION

The inflatable air mattress positioner system of the present invention, for use in positioning a cadaver in a casket, coffin or alternative container includes a pillow with a chamber in which is disposed a bladder with a plurality of air chambers, each one of which has a corresponding inflation tube and valve assembly in communication therewith to permit inflation thereof. A cushion material is also included in the pillow. The cushion material coacts with the air bladder to position the head, upper arms, chest and shoulder region of a cadaver so that the chin of the cadaver is positioned at an acceptable height in relation to the chest in a manner acceptable to the mortician and mourners. In addition, the assembly includes an inflatable air mattress (bladder) having a plurality of air chambers which are independently inflatable via an inflation tube and valve assembly to position a cadaver at an appropriate height and angle in the casket, coffin or alternative container for mourner viewing. Additional air bladders separate of the main inflatable air mattress (bladder) are also provided to be disposed under the cadaver to aid in positioning the cadaver's head, back, neck, torso, arms and other areas as desired, to be used as a spare or supplemental to the chambers in the main air mattress and tilt the cadaver along its longitudinal axis for mourner viewing.

Accordingly, it is an object of the present invention to provide an inflatable support system for positioning a cadaver in a casket, coffin or alternative container with unlimited adjustability.

It is also an object of the present invention to provide a partially pneumatic pillow as a component of an inflatable support system for a cadaver positioned in a casket, coffin or alternative container.

It is even another object of the present invention to provide a partially pneumatic pillow being formed of an inflatable portion and a cushion portion to adjustably support and maintain the position of the head of the cadaver with respect to the body.

It is another object of the present invention to have an inflatable support system including a air mattress (bladder) having a plurality of individually inflatable chambers which can be rearranged with respect to one another to position the cadaver for mourner viewing.

It is still another object of the present invention to provide a system of separately independent air bladders of one or more chambers which can be used with this system or any other system currently in use in caskets, coffins or alternative containers regardless of size, design or material used in their construction.

It is still another object of the present invention to provide a partially pneumatic pillow and an inflatable support system and a system of independent air bladders which may be removably installed in a casket, coffin or alternative container.

It is even another object of the present invention to provide a positioner which requires no alteration of the casket, coffin or alternative container or existing spring mattress system within the casket, coffin or alternative container and which is reusable for subsequent mourner viewings.

It is still another object of the present invention to provide a partially pneumatic pillow and an inflatable support system adapted to raise or lower and tilt or roll the cadaver in a casket, coffin or alternative container using no other materials (formalin bottles, conventional pillows, tissue paper, etc.) other than the various individual air bladders available within the positioning system.

It is still another object of this present invention to provide an inflatable mattress system that can entirely eliminate and replace the spring bed and crank system currently in use in caskets, coffins or alternative containers with no alteration other than omitting the spring bed and crank system components when the casket, coffin or alternative container is manufactured.

It is still another object of this present invention to provide an inflatable mattress (bladder) system that can entirely replace the shredded material, wood wool shavings or excelsior mattress system currently in use in caskets, coffins or alternative containers with no alteration other than omitting such material when the casket, coffin or alternative container is manufactured.

BRIEF DESCRIPTION OF THE DRAWINGS

Other important objects and features of the invention will be apparent from the following detailed description of the invention taken in connection with the accompanying drawings in which.

DETAILED DESCRIPTION OF THE INVENTION

Figure 1:
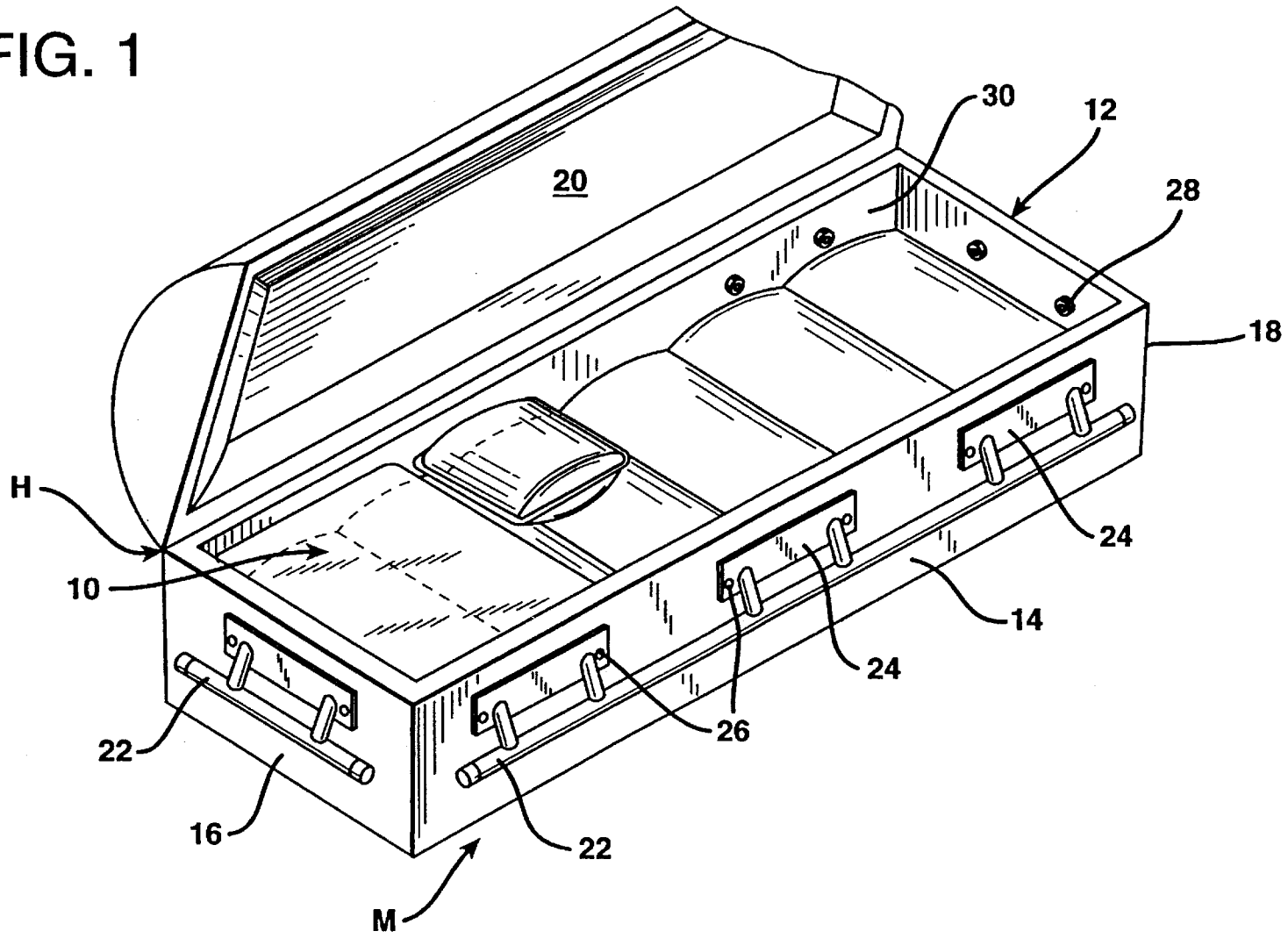
FIG. 1 is a top perspective view of a conventional casket having removably installed therein the inflatable air mattress support system of/the present invention.

Referring now to the drawings, where like elements are identified by similar reference numerals, in FIG. 1 an inflatable support system of the present invention is shown generally at 10 and is disposed in a casket 12. The inflatable support system 10 includes a plurality of coacting elements to adjustably support a cadaver for mourner viewing.

Figure 4:
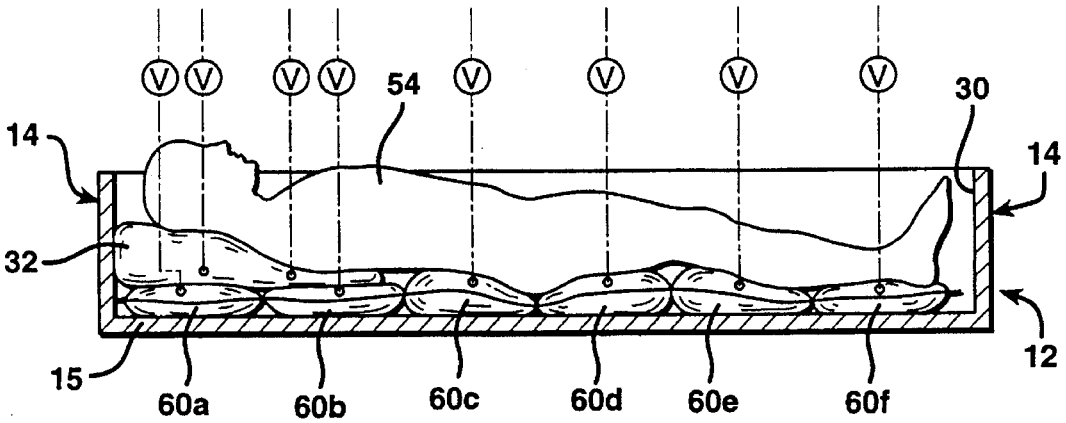
FIG. 4 is a cross-sectional view taken substantially along line 4—4 of FIG. 3, showing the inflatable air mattress support system of the present invention in a casket for adjustably supporting a cadaver for viewing.

The casket 12 may be of any conventional structure and includes side walls 14, a bottom 15, shown in FIG. 4 a forward end 16, a rearward end 18, a lid 20, and hand railings 22 extended along the side wall, 14 of the casket 12 to facilitate lifting and carrying the casket. The hand railings 22 are attached to the side walls 14 by any means known in the art such as with mounting hardware that includes mounting plates 24, or escutcheons, and mechanical fasteners such as screws or bolts 26 and nuts 28. The interior of the bottom 15 may be provided with the conventional spring-mattress (not shown) upon which the inflatable support system 10 may be positioned, or the assembly 10 can be positioned alone in the interior 30 of the casket on the bottom 15 thereof. Certain areas adjacent the casket are referred to as the hinge area side H and the viewing area M (mourner viewing) side for reference purposes with regard to the positioning of the air bladder positioner 10.

Figure 2:
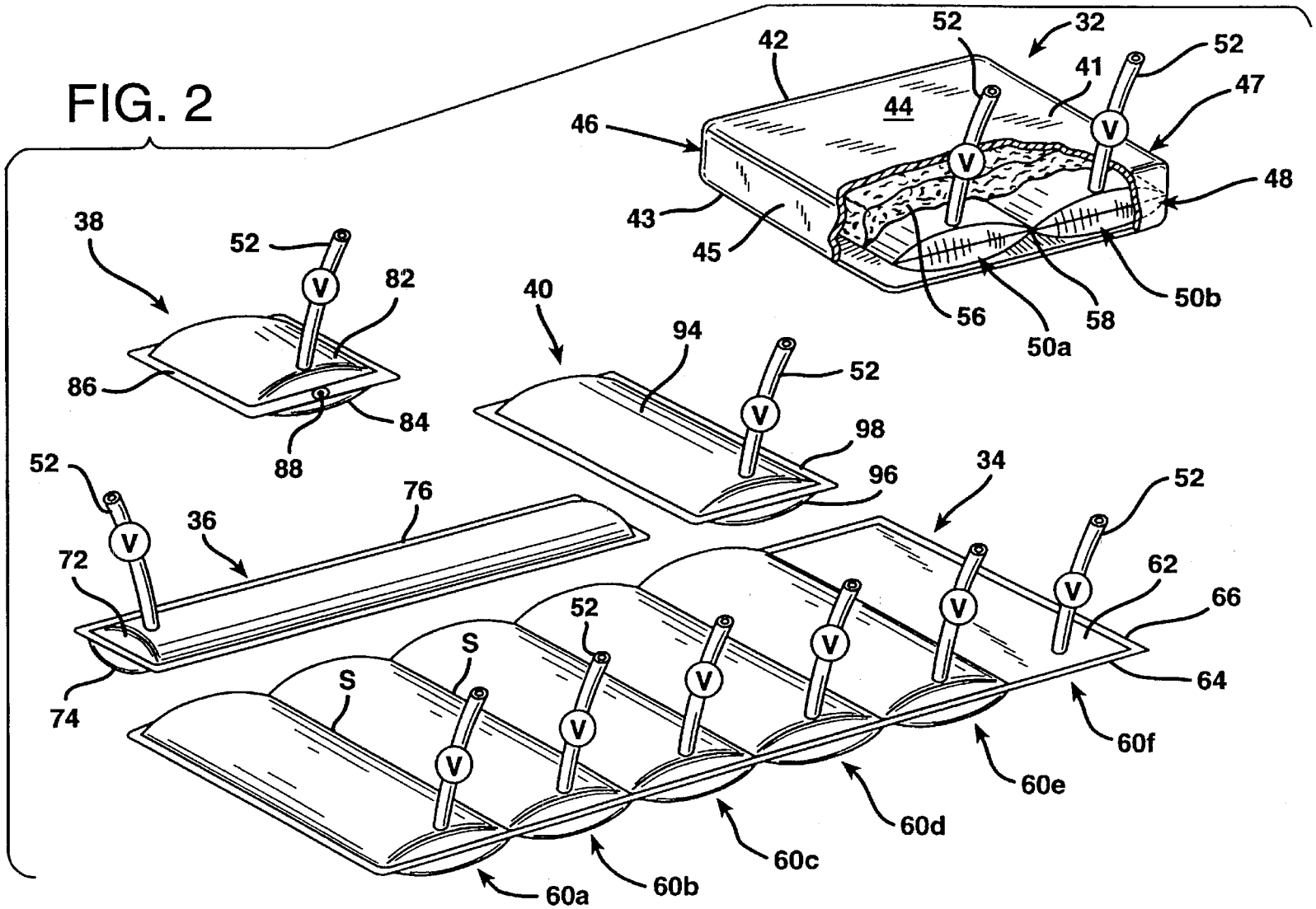
FIG. 2 partially fragmented view, in perspective of the components of the inflatable air mattress support system of the present invention.

Referring now to FIG. 2, the elements of the inflatable support system 10 may include a partially pneumatic pillow generally indicated at 32, an inflatable mattress (bladder) portion generally indicated at 34, a longitudinal bladder generally indicated at 36, a head, neck, torso, back or accessory bladder generally indicated at 38, a "spare" bladder generally indicated at 40, used in the event that one of the main air mattress chambers 60 a–f should develop a leak, and an arm positioning bladder generally indicated at 108, all of which are manufactured from a flexible plastic material as described hereinafter.

The partially pneumatic pillow 32 comprises a pillow case 42 having an exterior surface 44, a top 41, a bottom 43 and sides 45, 46, 47 and 48. Disposed within the pillow case 42 is a plurality of independently inflatable air chambers 50*a*, 50*b* which are preferably joined to one another, but not in communication with each other. Each one of the air chambers 50*a*, 50*b* includes a corresponding inflation tube 52 of flexible plastic material extending therefrom and in communication therewith. The inflation tubes 52 extend through the side surface 45 of the pillow case Each inflation tube 52 is provided with a valve V to control inflation and deflation of the corresponding air bladder 50*a*, 50*b*. The inflation tubes 52 preferably extend from the side surface of the pillow case 42 adjacent to the viewing area M.

The individual air chambers 50*a*, 50*b* can be joined together along a common seam 58. By way of example, the partially pneumatic pillow 32 can be approximately 25 inches long, 25 inches wide and 6 inches in height to conform to practically all casket, coffin, or alternative container interiors, although it will be understood that the pillow 32 can have other dimensions depending upon the internal proportions of the casket 12 and/or the size of the cadaver and/or the head to be supported. Additionally, it can be noted that more or less air chambers, interconnected or separate, can be used to obtain a desired positioning results in accordance with the present invention.

The partially pneumatic pillow 32 also includes, in a preferred embodiment a cushion material 56 such as loose polyester fiber material, foam rubber or the like, within the pillow case 42 to substantially cover the air chambers 50*a*, 50*b*. It is preferred that a layer of approximately two inches of the cushion material 56 be provided over the air chambers 50*a*, 50*b*, although this amount can be altered for altering the position of the cadaver to be supported. The material 56 will adapt to the contour of the cadaver, and particularly to the head. The cushion material 56 coacts with the air chambers 50*a*, 50*b*, to position the head of the cadaver in a natural position.

The mattress portion 34 of the invention includes a plurality of air chambers 60*a–f* which are each of a similar construction to pillow air chambers 50*a*, 50*b*. The mattress portion 34 may be formed in any manner known in the art such as from a pair of plastic sheets 62, 64 which are positioned in registration with each other so that a peripheral edge of each of the plastic sheets 62, 64 are joined to form a common seam 66 which extends around the peripheral edge of the mattress portion 34. The seam 66 may be formed by any known technique, some of which include cementing, electrical fusing, heat stamping, etc. Corresponding portions of the upper and lower sheets 62, 64 which are in registration are also joined together to form seams 66 extending across the mattress so that the independent air chambers 60*a–f* are formed.

Extending from each one of the air chambers 60*a–f* is a corresponding inflation tube 52 in communication with the respective air chamber. Each one of the inflation tubes 52 is provided with a corresponding valve V. The inflation tubes 52 and valves V are of a similar construction to the inflation tubes and valves associated with the partially pneumatic pillow 32. The inflation tubes 52 each communicate with a corresponding one of the air chamber in any manner known in the art, such as at a flange (not shown), or are cemented in position with respect to the corresponding air chamber. The inflation tubes 52 extend from the air chambers along the same side of the mattress portion 34 and will extend from the casket 12 at the viewing side M to facilitate handling and access by a mortician.

The longitudinal pillow 36 comprises a single bladder formed from a pair of plastic sheets 72, 74 which are joined together along their corresponding peripheral edges to form a seam 76 by the techniques described with reference to the mattress portion 34. The longitudinal pillow 36 also includes an inflation tube 52, preferably mounted at one end of the longitudinal pillow, for communication therewith to control inflation and deflation of the longitudinal pillow. The air tube 52 is also provided with a valve V to control inflation and deflation of the longitudinal pillow.

The head, neck, back, torso, accessory bladder 38 is similarly structured of two plastic sheets 82, 84 joined along their respective peripheral edges to form a seam 86. A grommet 88 may be formed at one side of the seam 86 and a corresponding grommet (not shown) may be formed on the seam at the opposite side of the bladder 38. The head, neck, back, torso, accessory bladder 38 includes an inflation tube 52 which is in communication with the bladder and extends from the upper sheet 82. The inflation tube 52 includes a valve V to control inflation and deflation of the bladder 38.

The spare bladder 40 which may replace or supplement chambers 60A, 60B, 60C, 60D, 60E, 60F, in the event of a leak also is formed from an upper plastic sheet 94 and lower plastic sheet 96 which have been joined along corresponding peripheral edges to form a seam 98. An inflation tube 52 extends from the upper sheet 94 and is in communication with the interior of the spare bladder. The inflation tube is provided with a valve V to control inflation and deflation of the spare bladder 40.

The arm positioning bladder 108 is similarly constructed of two plastic sheets 102 and 104 joined along their respective peripheral edges to form a seam 106. An inflation tube 52 extends from the upper sheet 102 and is in communication with the interior of the arm positioning bladder. The inflation tube 52 is provided with a valve V to control inflation and deflation of the arm positioning bladder and is designed of a size and shape that can effectively be concealed under a cadaver's arms so that the bladder is not obvious to the mourners while viewing.

Figure 3:
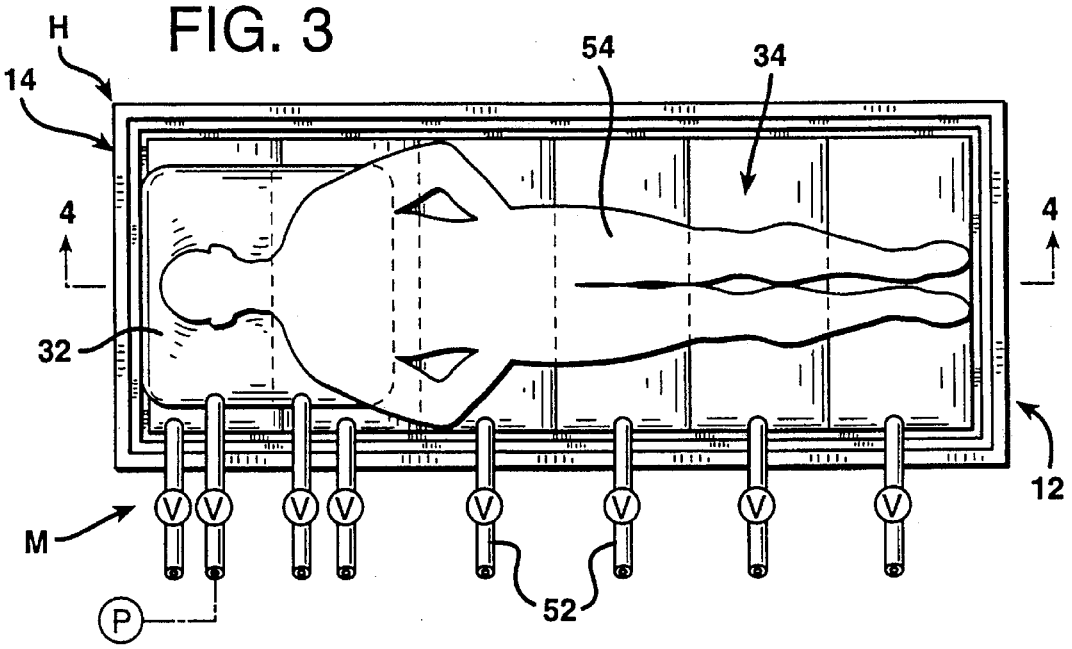
FIG. 3 is a top plan view of the inflatable air mattress support system of the present invention and means by which inflation of the invention can be implemented.

In FIGS. 3 and 4, the partially pneumatic pillow 32 and the inflatable mattress 34 are shown disposed in a casket 12. The inflation tubes 52 and valves V are preferably positioned together at the viewing side M of the casket 12, as shown, to facilitate the mortician's access to them. A pump P is connected to each one of the valves individually. The pump P is of the conventional variety and can be either hand or electric powered. As shown in FIG. 3, the partially pneumatic pillow 32 provides support and positioning of a cadaver 54, particularly to the head, shoulders, upper arms and back, and because it includes two air chambers 50*a*, 50*b*, the correct position of the chin of the cadaver can be obtained with respect to the remainder of the body regardless of the physical dimensions of the cadaver.

As shown in FIG. 4, the partially pneumatic pillow 32 and air chambers 60*a–f* of the mattress portion 34 are used in conjunction with an empty casket to achieve proper positioning of the cadaver for mourner viewing. In particular, the partially pneumatic pillow 32 and each one of the air chambers 60*a–f* of the mattress portion 34 provide support and proper positioning of the cadaver for mourner viewing. Importantly, the air pressure in each of the air bladders can be individually adjusted and varied to closely control positioning of the cadaver in the casket. In certain instances as the situation warrants, the lower air chamber 60*f*, which would support mostly the ankle and foot portion of cadaver 54, does not have to be fully inflated and could be rolled up or partially inflated depending on the length of the casket and/or whether it is a full or partial viewing of the cadaver 54.

Figure 5:
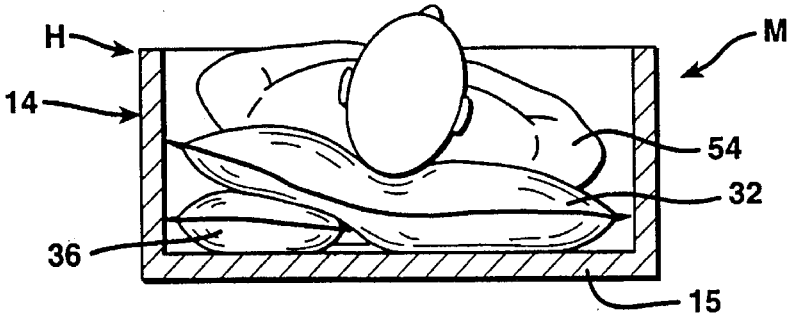
FIG. 5 is a cross-sectional view from the head of a casket showing the components of the present invention employed to position the cadaver for viewing.

As shown in FIG. 5, it is often desirable to tilt or cant the cadaver towards the viewing side M of the casket for proper viewing. This may be accomplished by inflating the longitudinal bladder 36 and positioning the bladder 36 under the mattress 34 to run along the length of the casket 12 at the hinge H side of the casket. The tilt of the body toward the mourners can be varied with on the amount of air pumped into the longitudinal bladder 36. The longitudinal bladder 36 may be formed as a separate bladder as shown, or may be formed integrally with the mattress 34 by conventional techniques as previously discussed. The inflation tube 52 of the longitudinal bladder 36 will extend for inflation and deflation at the hinge H side of the casket.

The grommets 88 of the small bladder 38 may or may not be provided for a string or cord (not shown) to be secured thereto so that the bladder 38. Then, the small pillow can be pulled from beneath the cadaver 54, by means of the cord upon conclusion of mourner viewing. One or a plurality of the small bladders 38 can be used and selectively positioned beneath the cadaver to support and position those portions of the body requiring such support. Upon conclusion of the mourner viewing, the small bladder(s) 38 can be withdrawn from beneath the cadaver.

The bladder and inflatable mattress which are part of the present invention may be formed of any suitable material, preferably a plastic sheet material, such as vinyl, polyethylene, urethane, or other known polymers, and in certain instances, the vinyl can be covered with cloth material. All of the air bladders are typically formed by joining two plastic sheets along the corresponding peripheral edges to form a common seam by known techniques such as cementing, electronic fusing, heat pressing or the like. The inflation tubes can be attached to each one of the air bladders with adhesive or by any other known techniques, or the tube can be inserted into a flange formed at the air cell.

In operation, one or more components of the air bladder positioner assembly 10 can be used with the known bed spring crank system or with an excelsior mattress, or the known system or methods can be entirely eliminated from the casket and the inflatable mattress system of the present invention can be used alone. This system is far less expensive to produce and more accurately positions the body for mourner viewing. In addition, the invention substantially reduces the amount of time a mortician must spend to properly arrange, display and position the cadaver for mourner viewing. The air bladder positioner assembly also is immediately adaptable for use with the caskets presently on the market and is substantially less expensive and requires no maintenance. In addition, the air bladder positioner assembly of the present invention can be reused or it can be buried or cremated along with the casket and remains.

For mourner viewing, the mortician positions the deflated mattress portion 34 in the base 15 of the casket 12. The mattress portion 34 can be positioned on top of a spring-mattress system already installed in the casket 12 or can be used alone with the casket. Of course, the mattress portion 34 can also be disposed in a casket having an excelsior mattress. The inflatable mattress 34 is disposed in the casket so that the inflation tubes 52 extend from the viewing side M of the casket 12 with the valves V are accessible for interconnection with the pump P. Each one of the air bladders 60*a–f* may then be inflated.

The partially pneumatic pillow 32, longitudinal bladder 36, head, neck, back, torso accessory bladder 38 and spare bladder 40 and an arm positioner 108 can also be selectively disposed in the casket as the situation warrants, depending upon the physiology and structural characteristics of the cadaver 54. If the longitudinal bladder 36 is employed, as earlier discussed, the air tube 78 will extend from the side of the casket adjacent the hinge H. All of the bladders being employed are then inflated before the cadaver 54 is placed thereon, as it is easier to adjustably deflate the pillows than it is to inflate the pillows under the weight of the cadaver. After the cadaver is disposed on the mattress and/or pillows, each one of the air bladders is bled and deflated where needed so that the cadaver rests in a proper position for mourner viewing as shown in to FIGS. 4 and 5.

In the event that any of the air chambers(s) of a bladder should deflate once the cadaver is correctly positioned, or during mourner viewing, spare bladders may be employed which can be easily and quickly inserted under the body at the location where the mattress has deflated so that the cadaver can be quickly repositioned with a minimal amount of adjustment and distraction.

Should the mortician prefer not to use the air bladder positioner assembly 10 to raise/lower, tilt along the longitudinal axis or along the transverse axis of the body, the mortician can use one or more of the individual bladders with the conventional spring mattress or excelsior and position the individual bladder under any part of the body that requires adjustment. Use of the individual bladders to make adjustment for various body contours obviates the need for use of empty formalin bottles, conventional pillows, tissue paper or other objects to support the body. Of course, these individual bladders are immediately deflatable, easily removable and reusable for successive viewing applications.

Upon conclusion of the mourner viewing period, all of the inflated air bladders 32, 36, 38, 40, 108 can be deflated and removed from beneath the body to be used again. The mattress 34 may be removed from the casket, coffin or alternative container by merely sliding it out from under the cadaver.

It will be understood that the embodiments described herein are merely exemplary and that persons skilled in the art may make variations and modifications without departing from the spirit and scope of the invention. All such modifications and variations are intended to be included within the scope of the invention as defined in the appended claims.

What is claimed is:

1. A reusable air bladder positioning system for positioning a cadaver in a casket comprising:

a partially pneumatic pillow including at least one inflatable air bladder and a cushioning material disposed over the at least one inflatable air bladder, the cushioning material coacting with the at least one inflatable air bladder for supporting a head of a cadaver and for adapting to the contour of a head of a cadaver;

an inflatable air mattress including a plurality of air bladders, each air bladder having an inflation tube and a valve assembly for independent inflation to support a cadaver in a casket; and a canting air bladder having an inflation tube and a valve assembly for independent inflation, the canting air bladder adapted for disposition above or below the inflatable air mattress and substantially along one side of a cadaver for canting a cadaver in a casket.

2. The system of claim 1 further including an extra air bladder having an inflation tube and a valve assembly for independent inflation, the extra air bladder coacting with the air mattress to replace or supplement the air mattress for positioning a cadaver in a casket.

3. The system of claim 2 further including an extra, partially pneumatic, pillow including at least one inflatable air bladder and a cushioning material disposed over the at least one inflatable air bladder, the extra pillow coacting with the air mattress to support a cadaver in a casket.

4. The system of claim 2 wherein the extra air bladder includes at least one grommet formed at the peripheral edge of the extra air bladder, the grommet adapted to receive a cord to remove the extra air bladder from beneath a cadaver.

5. The system of claim 4 further comprising an arm support air bladder having an inflation tube and a valve assembly for independent inflation, the arm support air bladder coacting with the air mattress for supporting a cadaver's arms in a casket.

6. The system of claim 5 wherein the arm support air bladder is sized and shaped to be concealed under a cadaver's arm.

7. A reusable air bladder positioning system for positioning a cadaver in a casket comprising:

a partially pneumatic pillow including at least one inflatable air bladder and a cushioning material disposed over the at least one inflatable air bladder;

an inflatable air mattress; and a canting air bladder adapted for disposition above or below the inflatable air mattress and substantially along one side thereof for canting a cadaver in a casket.

8. The system of claim 7 wherein the pillow includes an inflation tube and a valve assembly for controlling the passage of air through the inflation tube.

9. The system of claim 8 further comprising an arm support air bladder having an inflation tube and a valve assembly for independent inflation, the arm support air bladder coacting with the air mattress for supporting a cadaver's arms in a casket.

10. The system of claim 9 wherein the arm support air bladder is sized and shaped to be concealed under a cadaver's arm.

11. A method for positioning a cadaver in a casket comprising the steps of:

placing a reusable inflatable air bladder positioning system having a plurality of independently inflatable air bladders into a casket;

inflating the air bladders to support a cadaver;

laying a cadaver on the air bladder positioning system in a casket;

adjusting the inflation of the plurality of inflatable air bladders of the air bladder positioning system to position a cadaver in a casket for mourner viewing;

deflating the air bladder positioning system after mourner viewing;

removing the deflated air bladder positioning system from beneath a cadaver;

removing the deflated air bladder positioning system from a casket; and reusing the inflatable air bladder positioning system to position another cadaver in another casket.

12. The method of claim 11 wherein the air bladder positioning system includes a grommet having a cord attached thereto and the step of removing the air bladder positioning system from beneath a cadaver comprises grasping the cord and pulling the cord to remove the air bladder positioning system from beneath a cadaver.

* * * * *